US006843614B2

(12) United States Patent
Yodock, Jr. et al.

(10) Patent No.: US 6,843,614 B2
(45) Date of Patent: Jan. 18, 2005

(54) PORTABLE SECURITY SYSTEM

(76) Inventors: Leo J. Yodock, Jr., 623 NE. 5th Ter., Fort Lauderdale, FL (US) 33304; Leo J. Yodock, III, 2832 Cleveland St., Hollywood, FL (US) 33020; Guy C. Yodock, 623 NE. 5th Ter., Fort Lauderdale, FL (US) 33304

( * ) Notice: Subject to any disclaimer, the term of this patent is extended or adjusted under 35 U.S.C. 154(b) by 0 days.

(21) Appl. No.: 10/694,142

(22) Filed: Oct. 27, 2003

(65) Prior Publication Data

US 2004/0091315 A1 May 13, 2004

Related U.S. Application Data

(63) Continuation-in-part of application No. 10/140,603, filed on May 7, 2002, now abandoned.
(60) Provisional application No. 60/289,106, filed on May 7, 2001.

(51) Int. Cl.[7] ..... E01F 13/00
(52) U.S. Cl. ..... 404/6
(58) Field of Search ..... 404/6, 9; 256/1, 256/13.1

(56) References Cited

U.S. PATENT DOCUMENTS

| | | | | |
|---|---|---|---|---|
| 984,711 | A | 2/1911 | Stanley | 256/19 |
| 4,059,362 | A | 11/1977 | Smith | 404/6 |
| 4,391,077 | A | 7/1983 | Giess | 52/747 |
| 4,681,302 | A | 7/1987 | Thompson | 256/13.1 |
| 4,773,629 | A | 9/1988 | Yodock | 256/13.1 |
| 4,946,306 | A | 8/1990 | Yodock | 404/6 |
| 5,030,029 | A | 7/1991 | Johnsen | 404/6 |
| 5,123,773 | A | 6/1992 | Yodock | 404/6 |
| 5,245,787 | A | 9/1993 | Swenson | 49/34 |
| 5,452,542 | A | 9/1995 | Bardwell | 49/34 |
| 5,467,548 | A | 11/1995 | Ross | 40/612 |
| 5,498,101 | A | 3/1996 | Braverman | 404/6 |
| 5,531,540 | A | 7/1996 | Wasserstrom et al. | 404/6 |
| 5,605,413 | A | 2/1997 | Brown | 404/6 |
| 5,882,140 | A | 3/1999 | Yodock et al. | 404/6 |
| 6,149,339 | A | 11/2000 | Salloum et al. | 404/6 |
| 6,517,280 | B2 | 2/2003 | Carter | 404/6 |
| 6,666,616 | B2 * | 12/2003 | Yodock et al. | 404/6 |

* cited by examiner

*Primary Examiner*—Gary S. Hartmann
(74) *Attorney, Agent, or Firm*—Holland & Knight LLP

(57) ABSTRACT

A portable security system comprises two security units, located on opposite sides of a roadway or other path for vehicles, each consisting of at least two hollow barrier devices filled with a ballast material such as water, sand, chunks of rubber or the like. Adjacent barrier devices in each security unit are interconnected side-by-side, and a cable spans the two security units which is movable between an open position permitting the passage of vehicular traffic along the roadway and a closed position.

17 Claims, 7 Drawing Sheets

PORTABLE SECURITY SYSTEM

RELATED APPLICATION

This application is a continuation-in-part of U.S. patent application Ser. No. 10/140,603, filed May 7, 2002, now abandoned and entitled "PORTABLE SECURITY SYSTEM," which claims priority under 35 U.S.C. §119(e) to U.S. Provisional Application Ser. No. 60/289,106 filed May 7, 2001, for all commonly disclosed subject matter.

FIELD OF THE INVENTION

This invention relates to a security systems, and, more particularly, to a portable security system which is effective to prevent or at least slow the progress of a vehicle engaged in an attempted unauthorized entry into a facility such as a military base, power plant or other restricted access installation.

BACKGROUND OF THE INVENTION

Security at restricted access installations such as military bases, nuclear power plants and other facilities is of critical concern, particularly at facilities where personnel are housed on site, sensitive equipment is located or hazardous material is stored. One technique employed by terrorists and other groups which can have devastating results is a suicide mission where a truck or other vehicle filled with explosives is driven into the vicinity of one or more target buildings at an installation and detonated. Standard gates, fences or other obstacles deployed along the roadway leading to the installation are often ineffective to stop this type of attack, unless they are constructed to be permanent structures. In many instances, it is not desirable or feasible to install permanent barriers or other obstacles due to the temporary nature of the installation, space requirements and a variety of other factors.

SUMMARY OF THE INVENTION

The portable security system of this invention includes two security units, located on opposite sides of a roadway or other path for vehicles, which are spanned by an automatic or manually operated gate or cable. Each security unit consists of at least two barrier devices which are generally rectangular-shaped structures formed of rigid plastic or a similar material having a top wall, a bottom wall, opposed side walls and opposed end walls which collectively form a hollow interior. At least two barriers devices are positioned side-by-side on each side of the roadway, and then they are filled with a ballast material such as water, sand, chunks of rubber or the like. Adjacent barrier devices forming a security unit are interconnected by a connector device which includes first and second beams each extending through respective fork lift openings formed in the barrier devices, and a plate mounted atop and spanning both beams. A gate or cable extends across the roadway between the two security units, and is movable between an open position permitting the passage of vehicular traffic along the roadway and a closed position.

In one presently preferred embodiment, the gate which spans the two security units is formed of metal, fiberglass, plastic or the like, and it has a hollow interior which receives a steel cable. One end of the cable is secured to one of the beams connecting the barrier devices of one security unit, and the other end of the cable is formed with a loop. In the closed position of the gate, the loop end of the cable is secured to a hook, shackle or similar element mounted to one or both of the beams extending between the barrier devices of the other security unit. The gate may also be provided with a tire puncture strip which extends downwardly onto the roadway with the gate in a closed position.

In one alternative embodiment, the gate comprises a length of cable having one end affixed to one or both beams connecting the barrier devices of one security unit and its opposite end releasably mounted to a hook, shackle or the like carried by the beam(s) of other security unit. In a still further embodiment, the cable is secured at both ends to a cable support which comprises a hollow stanchion mounted to the plate spanning the beams, connecting the barrier devices of each security unit, and a T-shaped post which is telescopically received within the stanchion. An adjustment block carries each end of the cable, and one adjustment block is telescopically received within a head section of a T-shaped post associated with each security unit. Both the T-shaped post and the adjustment block are secured in place with pins.

In the event of an attack in which a vehicle attempts to proceed along the roadway toward a base or installation, the steel cable which forms the gate or is affixed to the gate arm is immediately engaged by the vehicle. The force of impact is transferred by the cable to each group of barrier devices within both security units which are effective to prevent or at least resist further forward movement of the vehicle. Essentially any number of barrier devices mounted side-by-side can be employed to form the two security units on either side of the roadway, each filled with a ballast material, thus providing substantial mass which would have to be dragged along by the vehicle in order for it to proceed forward once the cable is engaged. If a tire puncture strip is employed, the progress of the vehicle would be further impeded due to flat tires.

The portable security system of this invention is easily moved from one location to another by simply emptying the ballast material from the barrier devices, disconnecting the beams and removing the gate or cable. All components can then be quickly and easily reassembled at another site as desired.

DETAILED DESCRIPTION OF THE INVENTION

Figure 1:
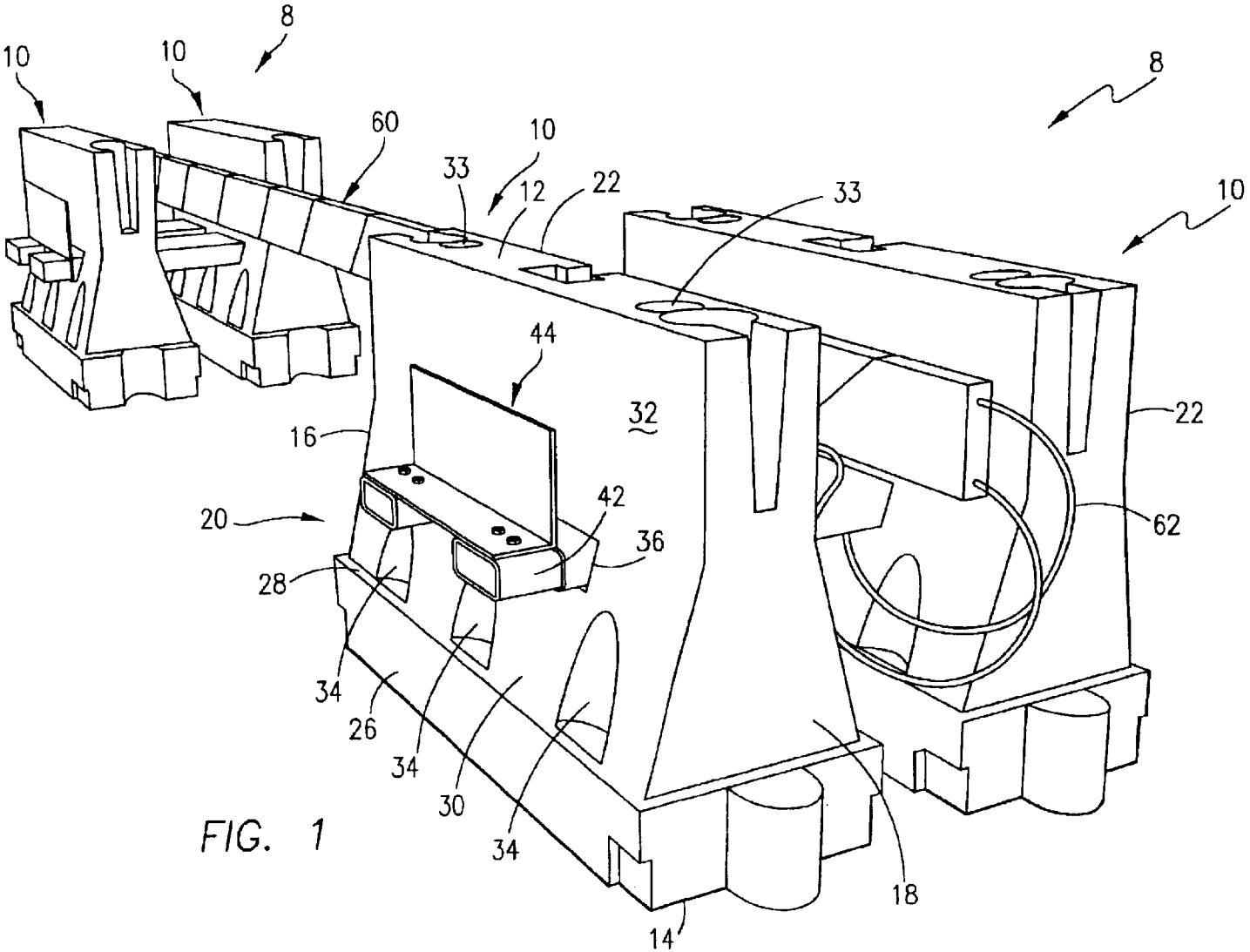
FIG. 1 is a perspective view of two security units located on either side of a roadway, with a gate arm in the closed position.

Referring now to FIG. 1, the portable security system of this invention comprises two security units 8 and 9 located on opposite sides of a roadway or other path for the transit of vehicles. Each security unit 8, 9, in turn, consists of two barrier devices 10 which are mounted side-by-side in a manner described in detail below. The construction of the barrier devices 10 shown in FIG. 1 is identical, and therefore only one is described in detail herein Each barrier device 10 comprises a top wall 12, a bottom wall 14, opposed end walls 16, 18, and, opposed sidewalls 20, 22 which are interconnected to collectively define a hollow interior. In the presently preferred embodiment, each of the walls 12–22 are formed of a semi-rigid plastic material chosen from the group consisting of low density polyethylene, acrylonitrile or butadiene styrene, high impact styrene, polycarbonates and the like. These plastic materials are all inherently tough and exhibit good energy absorption characteristics. They will also deform and elongate, but will not fail in a brittle manner at energy inputs which cause other materials to undergo brittle failure. Additionally, materials of this type are unaffected by weather and have excellent basic resistance to weathering, leaching and biodegradation. Additives such as ultraviolet inhibitors can be combined with the plastic materials making it further resistant to the effects of weather. Such plastic materials also retain their mechanical and chemical properties at low ambient temperatures.

The hollow interior of the barrier device 10 is preferably filled with a "ballast" material such as water or other liquid, or a flowable solid material such as sand, concrete and the like. For this purpose, the walls 12–22 of barrier device 10 have a thickness in the range of about one-eighth inch to one inch so as to perform satisfactorily in service. The barrier device 10 is preferably in the range of about six to eight feet in length, and, at the wall thickness noted above, has a weight when empty of about 80 to 140 lbs. When filled with a liquid such as water, the overall weight of the barrier is in the range of about 1400 to 2200 lbs. Flowable solid material such as sand and the like increases the weight of barrier device 10 further.

Each sidewall 20 and 22 includes a substantially vertically oriented curb reveal 26 which extends from the bottom wall 14 to a horizontally extending ledge or step 28 best shown in FIG. 1. Preferably, the curb reveal 26 has a vertical height of about nine inches, measured from the bottom wall 14 upwardly. The horizontal extent of the step 28 is preferably on the order of about 1½ inches measured in the direction from the outer edge of curb reveal 26 toward the hollow interior 24 of barrier device 10.

Extending upwardly at an acute angle from the step 28 is an intermediate section 30 which terminates at a vertically extending upper section 32. The upper section 32, in turn, extends from the intermediate section 30 to the top wall 12 of barrier 10 which is formed with a pair of fill holes 33 preferably having a diameter in the range of about 3–4 inches. Additionally, a number of stabilizers 34 are integrally formed in the intermediate section 30, at regularly spaced intervals between the end walls 16, 18.

In the presently preferred embodiment, a pair of hollow sleeves 36 are located within the hollow interior of each barrier device 10 and extend between the sidewalls 20, 22. For ease of illustration, only one of the sleeves 36 is shown in the Figs. A portion of each sleeve 36 is located in the intermediate section 30 of each sidewall 20, 22, and extends partially into the upper sections 32 thereof. The two sleeves 36 are positioned in the spaces between the three stabilizers 34 formed in the sidewalls 20, 22, and provide added internal support to the barrier 10 so that it retains its shape when filled with a ballast material.

Figure 2:
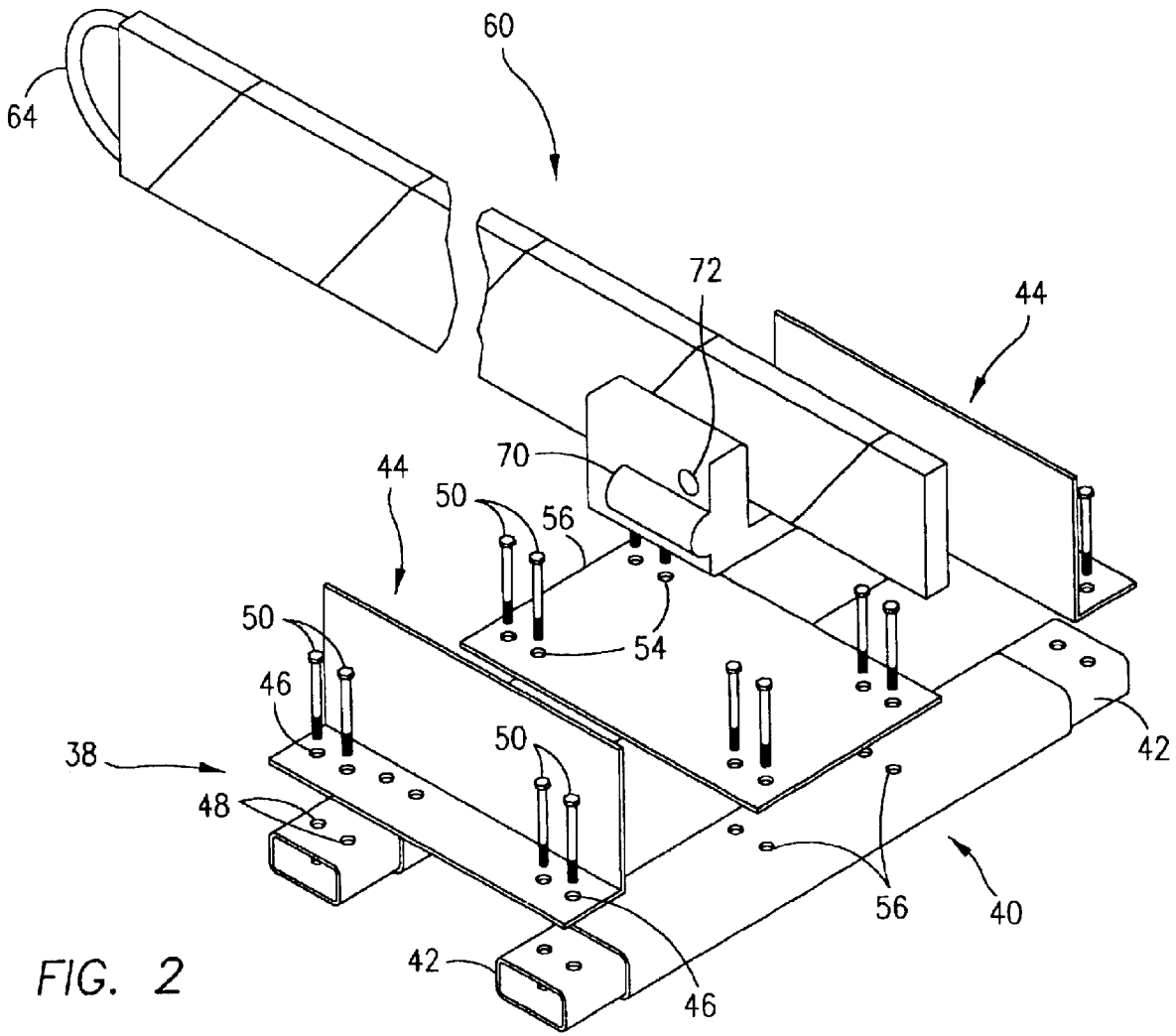
FIG. 2 is a disassembled view of the beam structure for mounting two barrier devices side-by-side.

Each of the sleeves 36 define a pass-through hole or channel adapted to receive the tines of a forklift truck to permit lifting and handling of the barrier devices 10. These pass-through holes are also used to support connecting structure for mounting two barrier devices 10 side-by-side thus forming a barrier unit 8 or 9. With reference to FIG. 2, the connecting structure includes a first beam 38 and a second beam 40 each having a reduced diameter section 42 at opposite ends which is sized to fit within the pass-through holes formed by the sleeves 36 in the barrier devices 10. The beams 38, 40 are preferably made of steel or other rigid material. As best seen in FIG. 1, the reduced diameter sections 42 protrude beyond the outer surface of the side wall 20 of one barrier device 10 and beyond the outer surface of side wall 22 of the other barrier device 10 in each of the security units 8 and 9. Each reduced diameter section 42 is positioned to mount an angle bracket 44. The angle bracket 44 is formed with holes 46 which align with holes 48 in each of the sections 42 to receive bolts 50 and nuts (not shown). When mounted to the beams 38, 40, one angle bracket 44 extends along the upper section 32 of the side wall 20 of one barrier device 10, and the other angle bracket 44 extends along the upper section 32 of the side wall 20 of the adjacent barrier device 10 of each security unit 8, 9. The angle brackets 44 prevent disengagement of the beams 38, 40 from the sleeves 36 of the barrier devices 10 and connect the two beams 38 and 40 together. In order to provide additional stability and a platform for mounting other structure, as described below, a steel plate 52 is secured between the first and second beams 38, 40. Aligning bores 54 and 56 formed in the plate 52 and beams 38, 40, respectively, receive bolts 50 to mount the plate 52 atop the beams 38, 40.

Figure 3:
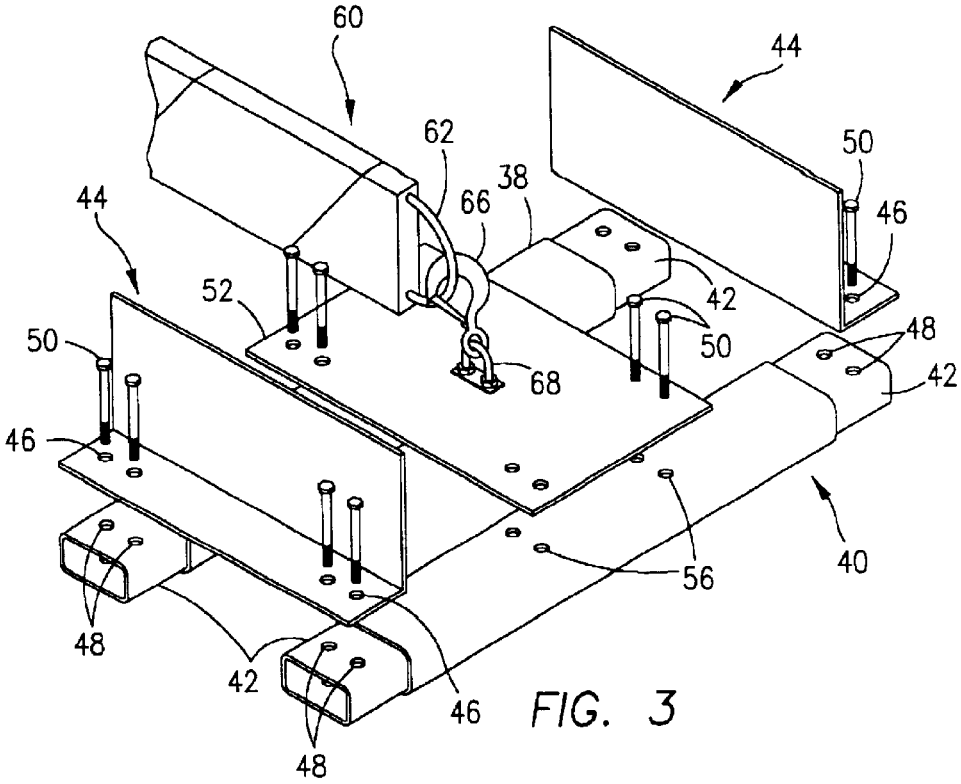
FIG. 3 is a view similar to FIG. 2 except depicting a hook for securing one end of the gate arm to the beam structure.

In one presently preferred embodiment, the plate 52 mounts one end of a gate arm 60 which spans the space between the security units 8 and 9. See FIG. 1. The gate arm 60 is preferably formed of metal, fiberglass or plastic and carries an endless cable 62 which extends along the length of the gate arm 60 and forms a loop 64 at one end. As best shown in FIG. 3, the loop 64 of cable 62 is releasably connected to a hook 66 with the gate arm 60 in the closed position. The hook 66, in turn, is mounted by a U-shaped connector 68 to the plate 52. The opposite end of cable 62 is looped around the second beam 40 of the security unit 9 to secure it in place. See FIG. 1. As schematically depicted in FIG. 2, the gate arm 60 is raised and lowered by operation of a motor 70 which rotates a shaft 72 connected to the gate arm 60. The gate arm 60 may also be manually raised and lowered, if desired. Additionally, a strip of sharp objects (not shown) capable of puncturing vehicle tires can be attached to the gate arm 60 so that it lies on the roadway with the gate arm 60 in the closed position.

Figure 4:
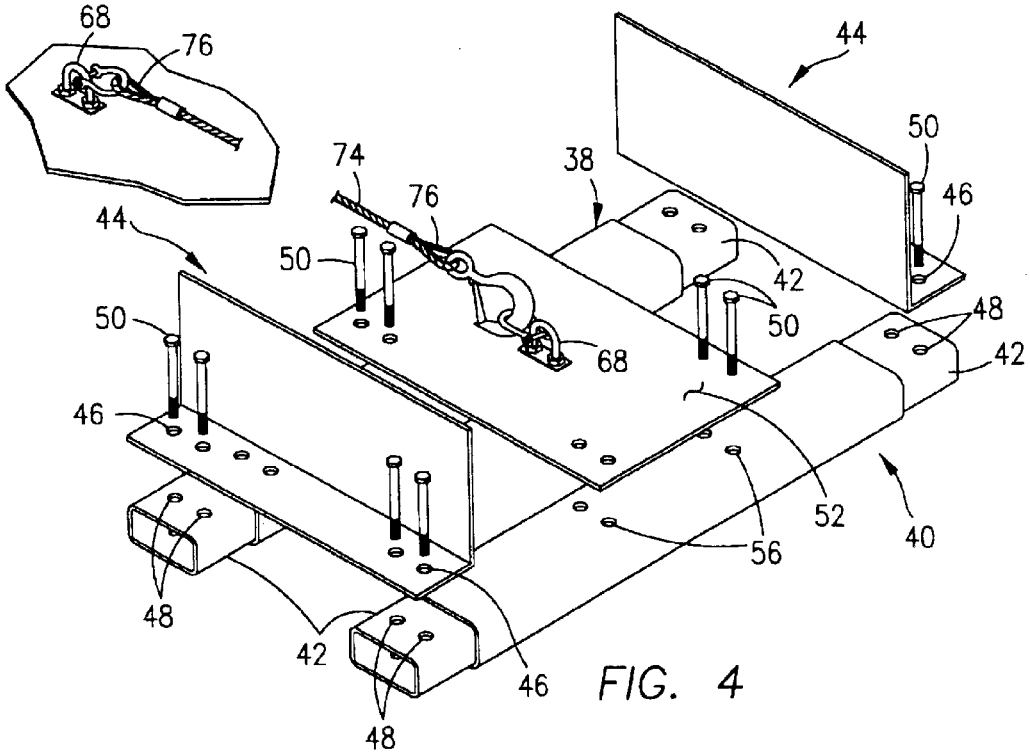
FIG. 4 is a view similar to FIG. 3 wherein a cable is depicted which spans the two security units as an alternative to the gate arm of FIG. 1.
Figure 5:
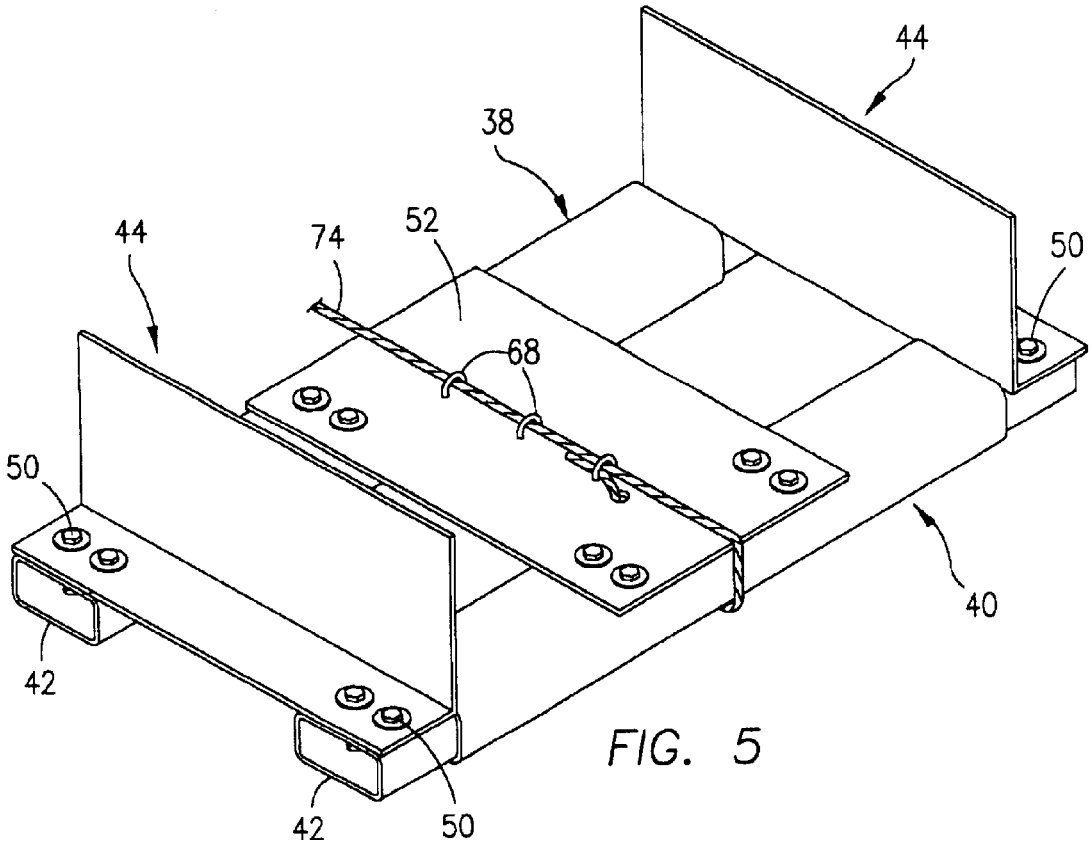
FIG. 5 is an assembled view of the beam structure illustrating one manner of attaching an end of the cable thereto.

In an alternative embodiment shown in FIGS. 4 and 5, the gate arm 60 is replaced by a length of cable 74 formed with loops 76 at each end. In FIG. 4, one loop 76 is releasably mounted to a hook 66 connected to the plate 52 of security unit 8 as described above in connection with a discussion of FIG. 3, and the loop 76 at the opposite end of the cable 74 is connected to a shackle 77 mounted by a connector 68 to the plate 52 of security unit 9. Alternatively, one end of the cable 74 may be mounted to one plate 52 using a number U-shaped connectors 68 as depicted in FIG. 5, while the opposite end of cable 74 is releasably connected to a hook 66. With the cable 74 in an extended position to block the passage of vehicles between the security units 8, 9, each end of the cable 74 is secured to a plate 52. To permit the passage of vehicles between the security units 8, 9, one end of the cable 74 is detached from a hook 66 and the cable 74 is allowed to rest on the ground so that the vehicle can drive over it.

Figure 6:
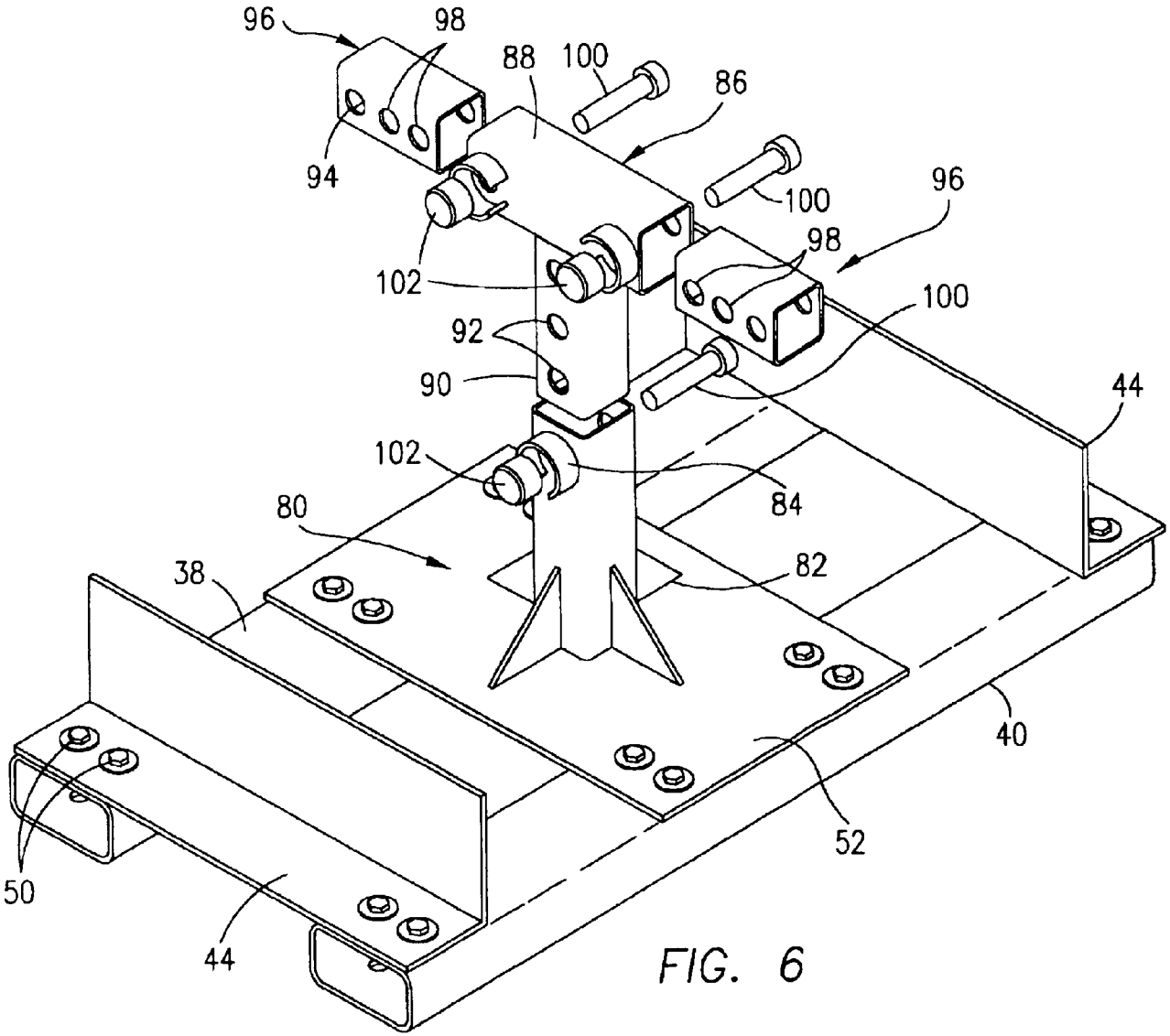
FIG. 6 is a view similar to FIG. 5 except depicting an alternative structure for supporting the ends of a cable.
Figure 7:
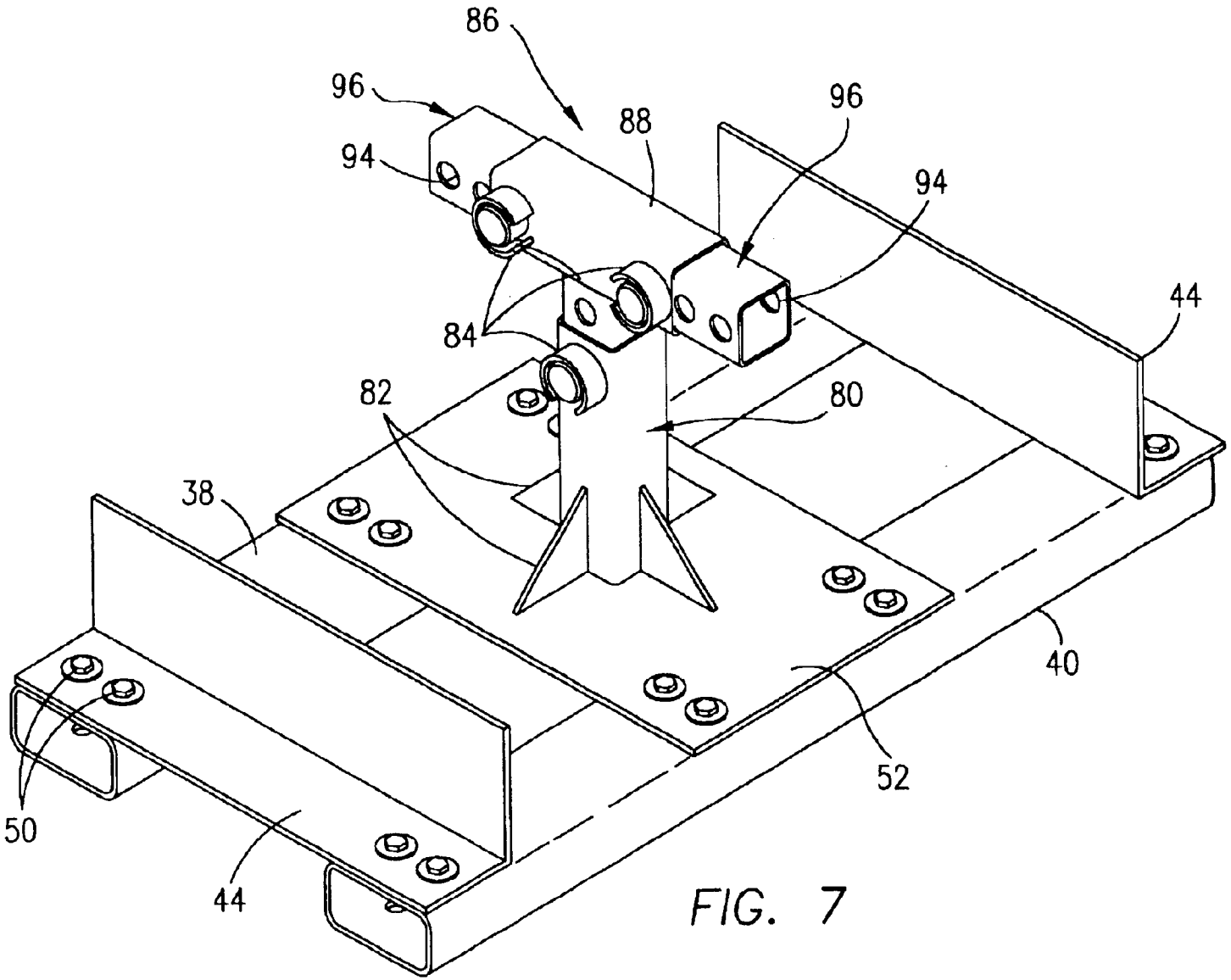
FIG. 7 is a view similar to FIG. 6 except with the cable support structure assembled.
Figure 8:
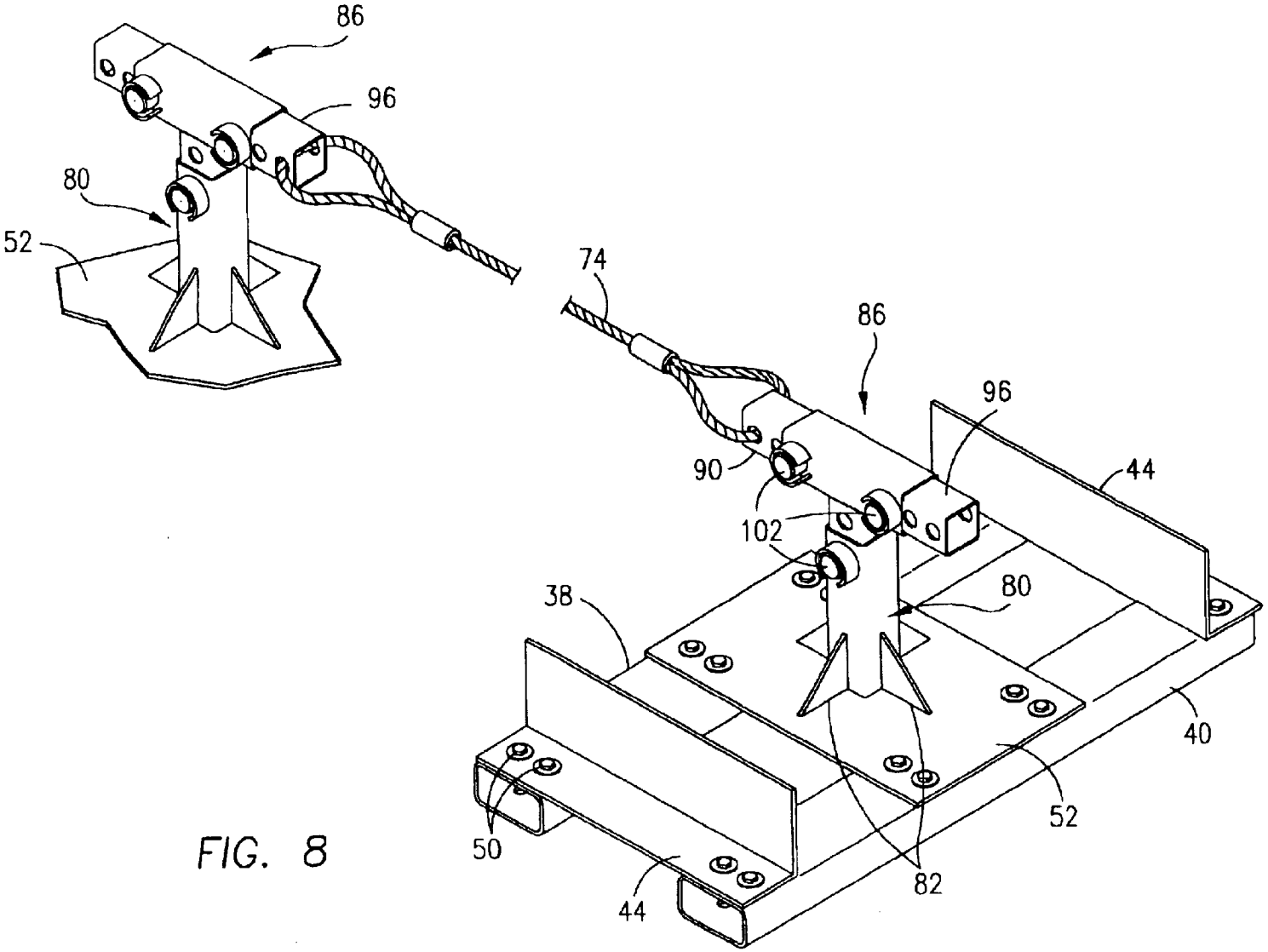
FIG. 8 is a schematic view of the assembled cable support structure depicted in FIGS. 6 and 7 with the cable attached thereto at both ends.

Referring now to FIGS. 6–8, a further embodiment of structure employed to mount the cable 74 to each of the security units 8 and 9 is shown. A hollow stanchion 80, having a number of radially outwardly projecting fins 82, at its base, is fixed by welding or other suitable means to the plate 52. The stanchion 80 is formed with a through bore, one end of which is surrounded by a lock guard 84. A T-shaped post 86 is formed with a head section 88 perpendicularly connected to a stem section 90 having a number of longitudinally spaced bores 92. The head section 88 is formed with a pair of spaced through bores, one end each having of which is surrounded by a lock guard 84. The loop 76 of the cable 74 is received within a bore 94 in an adjustment block 96, which is also formed with spaced positioning bores 98.

The stem section 90 of post 86 is telescopically received within the stanchion 80 so that one of the bores 92 in the stem section 90 aligns with the through hole in the stanchion. A pin 100 is then inserted through the aligning bores of the stanchion 80 and stem section 90 to secure the post 86 to the stanchion 80. In order to vary the vertical position of the post 86 relative to the stanchion 80, a different bore 92 in the stem section 90 can be aligned with the through bore in the stanchion 80. The free end of the pin 100 extends into the lock guard 84 on the stanchion 80, and a lock 102 is then affixed to such free end to maintain the pin 100 in place. The lock guard 84 functions to limit access to the lock 102 so that it is difficult to disengage from the pin 100 using a hammer, pry bar or the like.

In order to secure the cable 76 to a security unit 8 or 9, the adjustment block 96 is telescopically received within one end of the head section 88 of the post 86 so that one of the positioning bores 98 of the adjustment block 96 aligns with a through hole in the head section 88. If more or less slack is desired in the cable 76 as it extends between the two security units 8, 9, the adjustment block 96 can be telescoped in or out of the head section 88 to align the appropriate positioning bore 98 with the through bore in the head section 88. Once in place, a pin 100 is inserted through the aligning bores to secure the adjustment block 96 to the post 86, and a lock 102 is affixed to the free end of the pin 100. The adjustment block 96 is shown in position at either end of the head section 88 in FIG. 6 to denote that it could be telescoped into both ends of the head section 88 depending on how the security units 8 and 9 are oriented relative to a roadway.

Both ends of the cable 76 are mounted to the post 86 located on each of the security units 8 and 9 to place it in a "closed" position where access between the units 8, 9 is blocked. In order to allow traffic to pass between the units 8, 9, one or both ends of the cable 76 is disconnected from a respective post 86 by unlocking the lock 102, removing the pin 100 and then pulling the adjustment block 96 out of the head section 88 of the post 86 so that the cable 76 lays on the roadway in an "open" position.

While the invention has been described with reference to a preferred embodiment, it should be understood by those skilled in the art that various changes may be made and equivalents substituted for elements thereof without departing from the scope of the invention. In addition, many modifications may be made to adapt a particular situation or material to the teachings of the invention without departing from the essential scope thereof.

For example, only two barrier devices 10 are shown in the Figs. as comprising the security units 8 and 9. It should be understood that essentially any number of barrier devices 10 mounted side-by-side could be employed to form the units 8, 9 if additional mass is desired. Additionally, while reference has been made herein to a "cable" extending between the security units 8 and 9, it is intended that the term "cable" be broadly construed to include a chain, a rope or the like.

Therefore, it is intended that the invention not be limited to the particular embodiment disclosed as the best mode contemplated for carrying out this invention, but that the invention will include all embodiments falling within the scope of the appended claims.

We claim:

1. A portable security system, comprising:

a first security unit adapted to be located on one side of a roadway and a second security unit adapted to be located on an opposite side of the roadway, each of said first and second security units including:

(i) at least two barrier devices each having a top wall, a bottom wall, opposed side walls and opposed end walls collectively defining a hollow interior adapted to receive a ballast material; and (ii) barrier connecting structure extending between said at least two barrier devices to connect said at least two barrier devices together side-by-side;

a first cable mounting device mounted to said barrier connecting structure of said first security unit, and a second cable mounting device mounted to said barrier connecting structure of said second security unit;

a cable extending between said first and second cable mounting devices, at least one of said first and second cable mounting devices being movable between an engaged position and a disengaged position, said cable blocking passage between said first and second security units with said at least one of said first and second cable mounting devices in said engaged position.

2. The portable security system of claim 1 in which each of said barrier devices is formed with a pair of spaced openings which extend between said opposed side walls through said hollow interior, said spaced openings being adapted to receive the tines of a forklift truck.

3. The portable security system of claim 2 in which said at least two barrier devices of each of said first and second security units includes a first barrier device and a second barrier device, said barrier connecting structure of each of said first and second security units includes a first beam insertable within one of said openings of said first barrier device and one of said openings of said second barrier device, and a second beam insertable within the other of said openings of said first barrier device and the other of said openings of said second barrier device.

4. The portable security system of claim 3 in which each of said first and second beams has a reduced diameter section at opposite ends, said reduced diameter sections protruding beyond said side wall of each of said first and second barrier devices when inserted within said openings thereof.

5. The portable security system of claim 4 in which said barrier connecting structure further includes an angle bracket mounted to said reduced diameter section of said first and second beams at each of said opposite ends thereof.

6. The portable security system of claim 3 in which said barrier connecting structure further includes a plate which spans and is mounted to each of said first and second beams.

7. The portable security system of claim 1 in which each of said first and second cable mounting devices is a hook releasably mounted to said barrier connecting structure of respective first and second security units, one end of said cable being fixed to each of said hooks.

8. The portable security system of claim 1 in which each of said first and second cable mounting devices is a hook fixed to said barrier connecting structure of respective first and second security units, one end of said cable being releasably mounted to each of said hooks.

9. The portable security system of claim 1 in which said first cable mounting device is at least one connector which fixes one end of said cable to said barrier connecting structure of one of said security units, said second cable mounting device is a hook releasably mounted to said barrier connecting structure of the other of said security units.

10. The portable security system of claim 9 in which said barrier connecting structure further includes a plate which spans and is mounted to each of said first and second beams.

11. The portable security system of claim 1 in which at least one of said first and second cable mounting devices comprises:

a hollow stanchion fixed to one of said barrier connecting structures:

a post having a head section connected to a stem section, said stem section being telescopically received within said hollow stanchion, said head section releasably mounting one end of said cable.

12. The portable security system of claim 11 further including an adjustment block telescopically received with said head section of said post, said adjustment block being mounted to said cable.

13. A portable security system, comprising:

a first security unit adapted to be located on one side of a roadway and a second security unit adapted to be located on an opposite side of the roadway, each of said first and second security units including:

(i) a first barrier device and a second barrier device each including a top wall, a bottom wall, opposed side walls and opposed end walls collectively defining a hollow interior which receive a ballast material, each of said first and second barrier devices being formed with a pair of spaced openings which extend between said opposed side walls through said hollow interior;

(ii) barrier connecting structure which connects said at least two barrier devices together side-by-side, said barrier connecting structure including a first beam insertable within one of said openings of said first barrier device and one of said openings of said second barrier device, and a second beam insertable within the other of said openings of said first barrier device and the other of said openings of said second barrier device;

a first cable mounting device mounted to said barrier connecting structure of said first security unit, and a second cable mounting device mounted to said barrier connecting structure of said second security unit;

a cable extending between said first and second cable mounting devices, at least one of said first and second cable mounting devices being movable between an engaged position and a disengaged position, said cable blocking passage between said first and second security units with said at least one of said first and second cable mounting devices in said engaged position.

14. The portable security system of claim 13 in which each of said first and second beams has a reduced diameter section at opposite ends, said reduced diameter sections protruding beyond said side wall of each of said first and second barrier devices when inserted within said openings thereof.

15. The portable security system of claim 14 in which said barrier connecting structure further includes an angle bracket mounted to said reduced diameter section of said first and second beams at each of said opposite ends thereof.

16. The portable security system of claim 13 in which at least one of said first and second cable mounting devices comprises:

a hollow stanchion fixed to one of said barrier connecting structures:

a post having a head section connected to a stem section, said stem section being telescopically received within said hollow stanchion, said head section releasably mounting one end of said cable.

17. The portable security system of claim 16 further including an adjustment block telescopically received with said head section of said post, said adjustment block being mounted to said cable.

* * * * *